US007755284B2

(12) United States Patent
Takagi et al.

(10) Patent No.: US 7,755,284 B2
(45) Date of Patent: Jul. 13, 2010

(54) PLASMA DISPLAY PANEL

(75) Inventors: Kazushige Takagi, Hyogo (JP); Yoshiho Seo, Hyogo (JP); Hajime Inoue, Hyogo (JP); Tadayoshi Kosaka, Hyogo (JP); Koichi Sakita, Hyogo (JP)

(73) Assignee: Fujitsu Hitachi Plasma Display Limited, Miyazaki (JP)

( * ) Notice: Subject to any disclaimer, the term of this patent is extended or adjusted under 35 U.S.C. 154(b) by 305 days.

(21) Appl. No.: 11/808,447

(22) Filed: Jun. 11, 2007

(65) Prior Publication Data

US 2008/0079364 A1 Apr. 3, 2008

(30) Foreign Application Priority Data

Sep. 29, 2006 (JP) ..... 2006-268256

(51) Int. Cl.
*H01J 17/00* (2006.01)

(52) U.S. Cl. ..... 313/582

(58) Field of Classification Search ..... None
See application file for complete search history.

(56) References Cited

U.S. PATENT DOCUMENTS

| | | | | |
|---|---|---|---|---|
| 6,608,441 | B2 | 8/2003 | Kunii et al. | |
| 7,112,922 | B2 | 9/2006 | Tachibana et al. | |
| 7,233,107 | B2 | 6/2007 | Sawa et al. | |
| 7,271,538 | B2 * | 9/2007 | Sugimoto et al. | 313/582 |
| 7,462,987 | B2 * | 12/2008 | Jang et al. | 313/584 |
| 7,466,078 | B2 * | 12/2008 | Kim et al. | 313/586 |
| 7,482,754 | B2 * | 1/2009 | Eom | 313/586 |
| 2003/0076038 | A1 * | 4/2003 | Suzuki et al. | 313/582 |
| 2006/0164010 | A1 * | 7/2006 | Hwang et al. | 313/582 |

FOREIGN PATENT DOCUMENTS

| | | | |
|---|---|---|---|
| CN | 1344005 | | 4/2002 |
| CN | 1698166 | A | 11/2005 |
| CN | 100470711 | C | 3/2009 |
| EP | 1 406 288 | A2 | 4/2004 |
| EP | 1 528 587 | A1 | 5/2005 |
| EP | 1 659 605 | A2 | 5/2006 |
| JP | 11-213896 | | 8/1999 |

OTHER PUBLICATIONS

European Search Report issued in Patent Application No. EP 07 25 2079 dated on Jul. 16, 2008.

* cited by examiner

*Primary Examiner*—Ashok Patel
(74) *Attorney, Agent, or Firm*—McDermott Will & Emery LLP

(57) ABSTRACT

A plasma display panel includes a pair of substrates forming a discharge space between the substrates, and lateral barrier ribs extending in a row direction and longitudinal barrier ribs extending in a column direction that divide the discharge space into cells. Each lateral barrier rib is divided into two portions in the column direction such that a vent passage is formed in the divided portion. In the plasma display panel, raised portions, which are lower than the lateral barrier ribs and connect the lateral barrier ribs divided into the two portions with each other, are formed in the vent passage.

3 Claims, 5 Drawing Sheets

PLASMA DISPLAY PANEL

CROSS-REFERENCE TO RELATED APPLICATION

This application is related to Japanese application No. 2006-268256 filed on Sep. 29, 2006 whose priority is claimed under 35 USC §119, the disclosure of which is incorporated by reference in its entirety.

BACKGROUND OF THE INVENTION

1. Field of the Invention

This invention relates to a plasma display panel (hereinafter, referred to as "PDP"), and more particularly, relates to a PDP in which barrier ribs of a closed type that divide a discharge space into respective cells are disposed between a pair of substrates forming a panel.

2. Description of the Related Art

An AC drive three-electrode face discharge type PDP has been known as a conventional PDP. This PDP is manufactured by aligning a front-side substrate on which desired constituent elements such as electrodes, dielectric layers, phosphor layers and barrier ribs are formed and a back-side substrate face to face with each other and by sealing the peripheral portion thereof.

The sealing process of the front-side substrate and the back-side substrate is carried out through the following processes: a glass sealing material containing low-melting point glass is applied to the peripheral portion of the substrates and the glass sealing material is fused and anchored by heat so that the substrates are bonded to each other. In this bonding process, a vacuum-exhausting process is carried out on the inside of the panel through a vent pipe formed on the back face side of the back-side substrate so that impurity gases are removed and an inert gas such as Ne and Xe is then sealed in the panel as a discharge gas.

In this PDP, barrier ribs are formed through the following processes: a paste-form material for the barrier ribs, made from glass frit, a binder resin and a solvent, is applied to a substrate and dried thereon so that a material layer for barrier ribs is formed, and the material layer for barrier ribs is patterned to form a pattern layer for barrier ribs is formed, and by firing the pattern layer for barrier ribs, the barrier ribs are formed.

As the structure of the barrier ribs, the following structures are employed: a linear barrier-rib structure (referred to as a stripe rib structure) in which a discharge space is separated only in the row direction by forming a plurality of barrier ribs in the column direction, and a closed-type barrier-rib structure (referred to as a box rib structure, a waffle rib structure, a mesh rib structure, etc.) in which the discharge space is divided into respective cells by forming barrier ribs in the row direction and barrier ribs in the column direction (see Japanese Unexamined Patent Publication No. Hei 11-213896). In recent years, in order to improve the display brightness and achieve pixels with high precision, there have been strong demands for PDPs having the closed-type barrier-rib structure.

As described above, in the manufacturing process of the PDP, impurity gases need to be removed from the inside of the panel by carrying out a vacuum exhausting operation through a vent pipe. In this case, the PDP having the closed-type structure of barrier ribs has a smaller ventilation conductance in the panel in comparison with the PDP having the linear structure of barrier ribs, resulting in difficulty in exhausting the impurity gases. When the removal of the impurity gases is insufficient, the characteristics of the panel deteriorate. More specifically, there is a reduction in the brightness and variations in the voltage due to degradation of the phosphor, and display irregularities in the panel tend to be caused.

For this reason, with respect to the PDP having the closed-type structure of barrier ribs, various structures for barrier ribs, used for improving the vent (exhaust) path inside the panel, have been proposed. For example, in the case of a PDP having a rectangular cell structure formed by dividing the discharge space by barrier ribs in the row direction and barrier ribs in the column direction, a structure has been known in which each barrier rib in the row direction is divided into two portions in the column direction, a groove formed in the divided portion is used as a vent passage so that this vent passage is utilized as a vent path when bonding the front-side substrate and the back-side substrate to each other so as to be sealed.

In the case of this barrier-rib structure with a vent passage, since, upon firing the barrier ribs, the barrier ribs in the column direction shrink due to thermal shrinkage at the time of the firing process, the barrier ribs in the row direction tilt toward the cell side, resulting in a narrowed cell area. For this reason, the aperture ratio (area of cell region/area of display region) becomes smaller, resulting in a problem of low display brightness. Here, a phosphor paste is applied to the inside of each cell, and by firing the phosphor paste, the phosphor layer is formed; however, the reduction in the aperture ratio tends to impair the stability in the phosphor paste applying process.

SUMMARY OF THE INVENTION

The present invention, which has been made to solve the above-mentioned problems, provides a structure in which, at a vent passage formed by dividing each barrier rib in the row direction into two portions in the column direction, a raised portion, which is lower than each barrier rib in the row direction and connects the two portions of the barrier rib in the row direction that have been divided, is formed so that it becomes possible to prevent the barrier ribs in the row direction from tilting toward the cell side at the time of firing the barrier ribs.

The present invention provides a plasma display panel comprising: a pair of substrates forming a discharge space between the substrates; and lateral barrier ribs extending in a row direction and longitudinal barrier ribs extending in a column direction that divide the discharge space into cells, each lateral barrier rib being divided into two portions in the column direction such that a vent passage is formed in the divided portion, wherein raised portions, which are lower than the lateral barrier ribs and connect the lateral barrier ribs divided into the two portions with each other, are formed in the vent passage.

In accordance with the present invention, it becomes possible to prevent a reduction in the aperture ratio of the cells with a sufficient ventilation conductance property being maintained, and consequently to achieve a panel having high brightness and improve the stability in the phosphor applying process.

DETAILED DESCRIPTION OF THE INVENTION

Figure 1A:
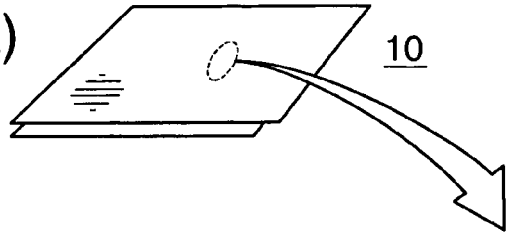
FIGS. 1(*a*) and 1(*b*) are explanatory drawings showing a structure of a PDP in accordance with an embodiment of the present invention.

In the present invention, the paired substrates include substrates made of materials such as glass, quartz and ceramics, and also include substrates prepared by forming desired constituent elements such as electrodes, an insulating film, a dielectric layer, a protective film and the like on these substrates.

The above-mentioned electrodes can be formed by using various materials and methods known in the corresponding field. With respect to the materials used for the electrodes, for example, transparent conductive materials such as ITO and $SnO_2$ and metal conductive materials such as Ag, Au, Al, Cu and Cr may be adopted. With respect to the formation method of the electrodes, various methods known in the corresponding field may be used. For example, a thick-film forming technique such as printing may be used, or a thin-film forming technique using a physical deposition method or a chemical deposition method may be used. With respect to the thick-film forming technique, for example, a screen printing method is listed. In the thin-film forming technique, the physical deposition method includes a vapor deposition method, a sputtering method and the like. The chemical deposition method includes a thermal CVD method, a photo CVD method and a plasma CVD method.

In the present invention, a discharge space, formed between a pair of substrates, is divided into respective cells by lateral barrier ribs extending in the row direction and longitudinal barrier ribs extending in the column direction. The lateral barrier ribs extending in the row direction and the longitudinal barrier ribs extending in the lateral direction are not necessarily made orthogonal to each other, and may be made to cross at a desired angle. The heights of the lateral barrier ribs extending in the row direction and the longitudinal barrier ribs extending in the column direction are not necessarily the same, and may be made different from each other.

The lateral barrier ribs extending in the row direction and the longitudinal barrier ribs extending in the column direction may be formed by using a method such as a transferring method, a sand blasting method and a photosensitive paste method.

For example, in the transferring method, by using a transferring intaglio plate with concave sections having a pattern of barrier ribs, a paste-form material for the barrier ribs, made from glass frit, a binder resin, a solvent and the like, is filled in the concave sections of the transferring intaglio plate, and transferred onto a substrate, and by firing these, the barrier ribs are formed. In the sand blasting method, a paste-form material for the barrier ribs, made from glass frit, a binder resin, a solvent and the like, is applied onto a substrate and dried thereon, and cutting particles are blasted onto the material layer for the barrier ribs, with a cutting mask having openings corresponding to the pattern of the barrier ribs attached thereto, and the material layer for the barrier ribs exposed to the openings of the mask are cut, and the resulting substrate is fired so that barrier ribs are formed. Moreover, in the photosensitive paste method, instead of the cutting process by the use of cutting particles, a photosensitive resin is used as the binder resin, and a layer having a pattern of barrier ribs is formed through exposing and developing processes using of a mask, and by firing these, the barrier ribs are formed.

In the above-mentioned structure, the raised portions may be formed on lines connecting the centers of respective cell areas in the column direction, or may be continuously formed in the row direction.

Based on embodiments shown in the drawings, in the following description, the present invention will be discussed in detail. However, the present invention is limited by these, and various modifications may be made therein.

Figure 1B:
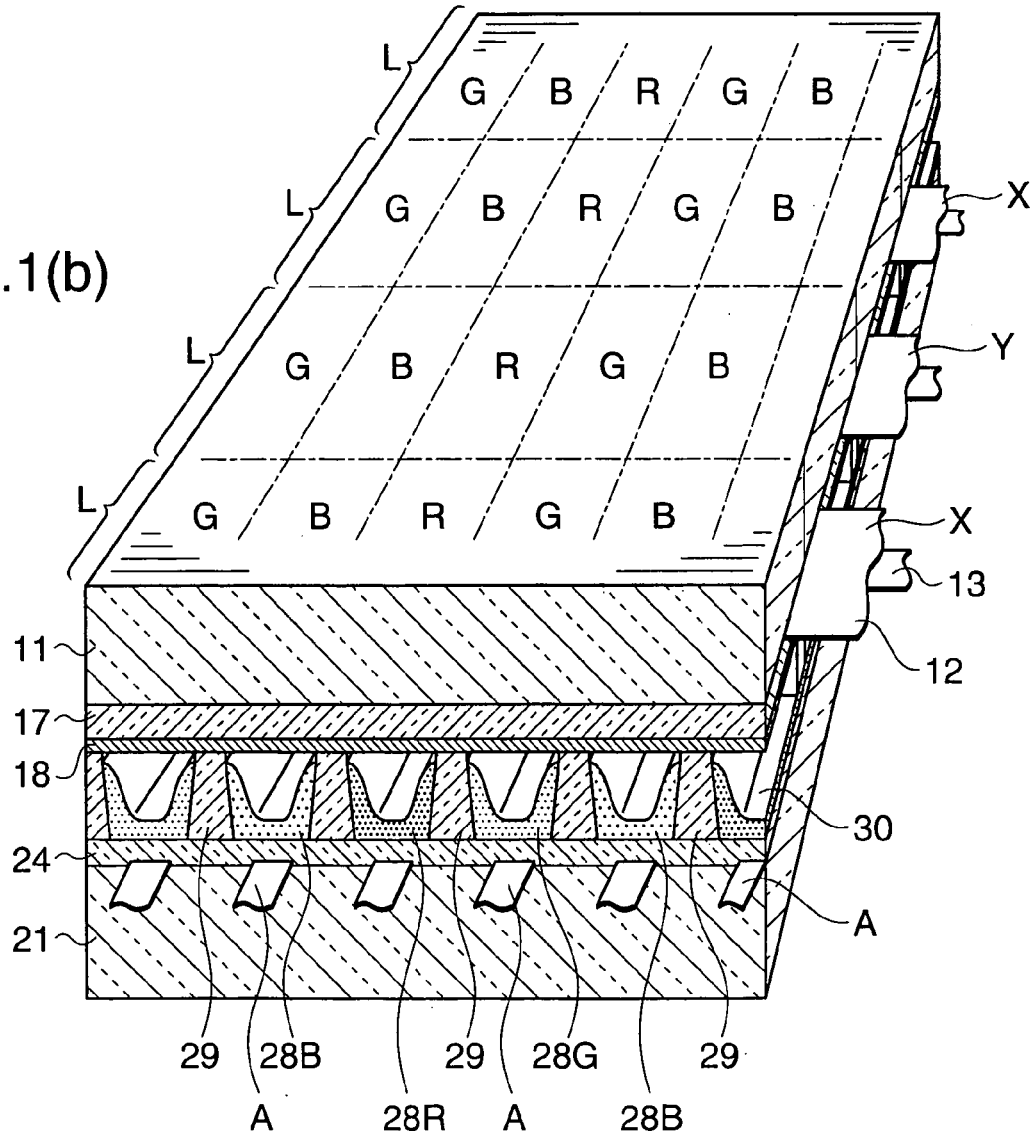

FIGS. 1(*a*) and 1(*b*) are explanatory views that show a structure of a PDP in accordance with an embodiment of the present invention. FIG. 1(*a*) shows the entire structure of the PDP, and FIG. 1(*b*) is a partially exploded perspective view of the PDP. This PDP is a three-electrode face discharge type PDP of an AC drive type for color display.

The PDP 10 is constituted by a substrate 11 on the front face side on which constituent elements that provide functions as the PDP are formed and a substrate 21 on the back face side. As the substrate 11 on the front face side and the substrate 21 on the back face side, glass substrates are used; however, in addition to the glass substrates, for example, quartz substrates and ceramics substrates may be used.

Display electrodes X and display electrodes Y are disposed with equal intervals in the horizontal direction on the inner side face of the substrate 11 on the front face side. All the intermediate portions between the adjacent display electrodes X and display electrodes Y form display lines L. Each of the display electrodes X and Y is constituted by a transparent electrode 12 with a wide width, made of ITO, $SnO_2$ or the like, and a bus electrode 13 with a narrow width, made of metal, such as Ag, Au, Al, Cu, Cr or a laminated body thereof (for example, Cr—Cu—Cr laminated structure), or the like. With respect to the display electrodes X and Y, in the case of Ag and Au, a thick-film forming technique such as screen printing may be used, and in the case of other materials, a thin-film forming technique, such as a vapor deposition method and a sputtering method, and an etching technique may be used, so that the display electrodes having a desired number, thickness, width and intervals are formed.

Here, in the present PDP, a PDP having a so-called ALIS structure, in which the display electrodes X and the display electrodes Y are disposed with equal intervals, with all the intermediate portions between the adjacent display electrodes X and display electrodes Y forming display lines L, is shown; however, the present invention may be applied even to a PDP having a structure in which paired display electrodes X and Y are disposed with a gap (non-discharging gap) causing no discharge.

A dielectric layer 17 is formed on the display electrodes X and Y in a manner so as to cover the display electrodes X and Y. The dielectric layer 17 is formed by applying a glass paste made from glass frit, a binder resin and a solvent onto a substrate 11 on the front face side through a screen printing method and by firing the resulting substrate. The dielectric layer 17 may be prepared by forming a $SiO_2$ film through a plasma CVD method.

A protective film 18, used for protecting the dielectric layer 17 from damage caused by collision of ions generated by a discharge in displaying, is formed on the dielectric layer 17. This protective film is made of MgO. The protective film may be formed by using a known thin-film forming process in the corresponding field, such as an electron beam vapor deposition method and a sputtering method.

A plurality of address electrodes A are formed on the inner side face of the substrate 21 on the back face side in a direction crossing the display electrodes X and Y in a plan view, and a dielectric layer 24 is formed so as to cover the address electrodes A. Each of the address electrodes A is used for generating an address discharge so as to select a light-emitting cell at an intersection with the Y electrode, and formed into a three-layer structure of Cr—Cu—Cr. The address electrodes A may be formed by using another material such as Ag, Au, Al, Cu, or Cr. In the same manner as with the display electrodes X and Y, with respect to the address electrodes A, in the case of Ag and Au, a thick-film forming technique such as screen printing may be used, and in the case of other materials, a thin-film forming technique such as a vapor deposition method and a sputtering method, and an etching technique may be used, so that the address electrodes having a desired number, thickness, width and intervals are formed. The dielectric layer 24 may be formed by using the same material and the same method as the dielectric layer 17.

A plurality of barrier ribs 29 having a lattice pattern, which divide a discharge space into respective cells, are formed on the dielectric layer 24 between the adjacent address electrodes A. The barrier ribs 29 having the lattice pattern are also referred to as box ribs, waffle ribs and mesh-shaped ribs. The barrier ribs 29 may be formed by using a method such as a transferring method, a sand blasting method and a photosensitive paste method. For example, in the transferring method, by using a transferring intaglio plate with concave sections having a pattern of barrier ribs, a glass paste, made from glass frit, a binder resin, a solvent and the like, is filled in the concave sections of the transferring intaglio plate, and transferred onto a substrate, and by firing these, barrier ribs are formed. In the sand blasting method, a glass paste, made from glass frit, a binder resin, a solvent and the like, is applied onto the dielectric layer 24 and dried thereon, and cutting particles are then blasted onto the glass paste layer, with a cutting mask having openings corresponding to the pattern of the barrier ribs attached thereto, so that the glass paste layer exposed to the openings of the mask is cut, and the glass paste layer that has been subjected to the cutting process is fired so that barrier ribs are formed. Moreover, in the photosensitive paste method, instead of the cutting process by the use of cutting particles, a photosensitive resin is used as the binder resin, and after carrying out exposing and developing processes using a mask, the resulting layer is fired so that barrier ribs are formed.

Phosphor layers of 28R, 28G and 28B having red (R), green (G) and blue (B) colors respectively are formed on side faces and a bottom face of each of cells having a rectangular shape in a plan view, which is surrounded by the barrier ribs 29 having a lattice pattern. The phosphor layers 28R, 28G and 28B are formed through processes in which: a phosphor paste containing phosphor powder, a binder resin and a solvent is applied to the inside of each cell surrounded by the barrier ribs 29 by using a screen printing method or a method using a dispenser, and after repeating this process for each of the colors, the resulting layers are fired. These phosphor layers 28R, 28G and 28B may also be formed through a photolithographic technique by using a sheet-shaped phosphor layer material (so-called green sheet) containing phosphor powder, a photosensitive material and a binder resin. In this case, a sheet having a desired color is affixed to the entire face of a display area on the substrate, and this is exposed and developed, and by repeating these processes for each of the colors, the phosphor layers of the respective colors are formed in the corresponding cells.

A PDP is manufactured through the following processes: the above-mentioned substrate 11 on the front face side and substrate 21 on the back face side are placed face to face with each other so that the display electrodes X and Y cross the address electrodes A, and the peripheral portion is sealed, with a discharge space 30 surrounded by the barrier ribs 29 being filled with a discharge gas containing Xe and Ne in a mixed state. In this PDP, the discharge space 30, located each of the intersections between the display electrodes X and Y and the address electrodes A, forms one cell (unit light-emitting area) that is the minimum unit for display. One pixel is configured by three cells of R, G and B.

In the following description, embodiments of the barrier ribs will be discussed.

Figure 2:
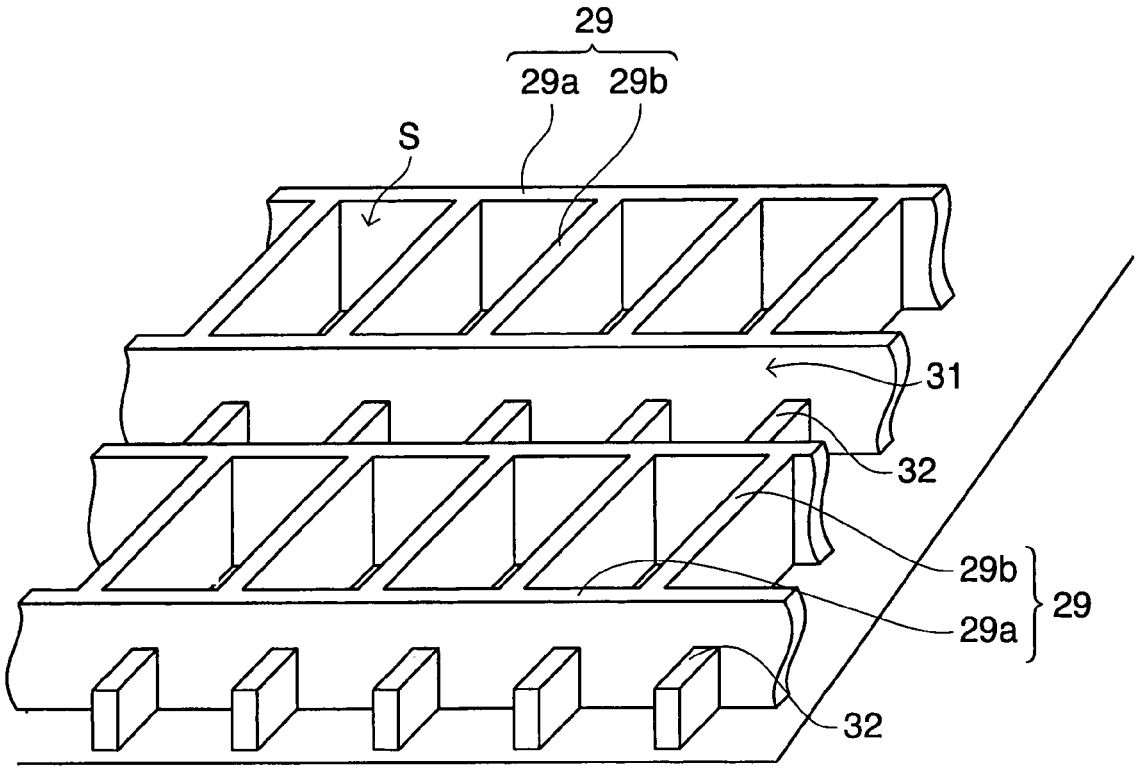
FIG. 2 is a perspective view showing a first embodiment of barrier ribs of the PDP in accordance with the present invention.

FIG. 2 is a perspective view that shows a first embodiment of the barrier ribs of a PDP in accordance with the present invention.

As shown in this figure, in the PDP of the present embodiment, a discharge space, formed between the substrate on the front face side and the substrate on the back face side, is divided by barrier ribs 29. The barrier ribs 29 are formed on the substrate on the back face side.

The barrier ribs 29 include lateral barrier ribs 29*a* that extend in the row direction, and longitudinal barrier ribs 29*b* that extend in the column direction, a discharge space is divided by the lateral barrier ribs 29*a* and the longitudinal barrier ribs 29*b* into respective cells S. In a plan view, each cell S has a rectangular shape. Each barrier rib 29*a* in the row direction is divided into two portions in the column direction, and a groove at the divided position forms a vent passage 31.

Figure 3A:
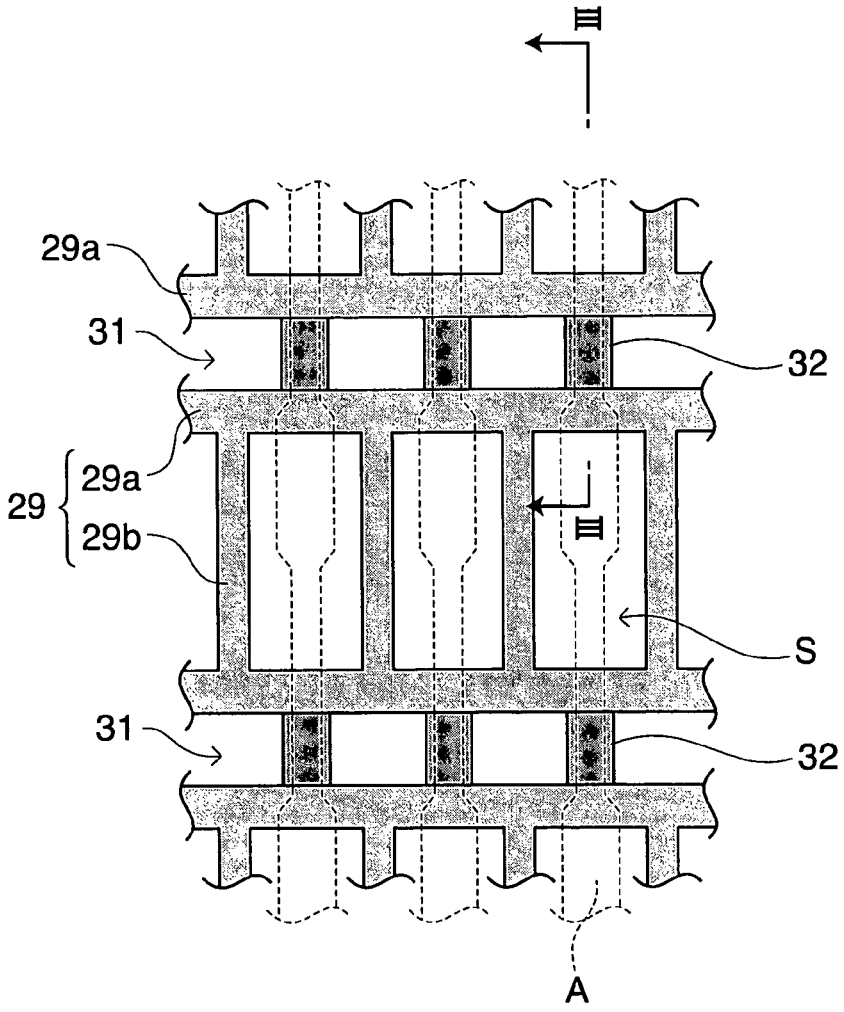
FIGS. 3(*a*) and 3(*b*) are explanatory diagrams showing a state in which the barrier ribs of the first embodiment of the present invention are viewed from above.
Figure 3B:
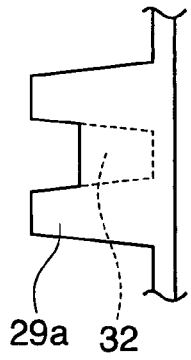

FIG. 3(*a*) is an explanatory view that shows a state in which the barrier ribs of the first embodiment of the present invention are viewed from above; and FIG. 3(*b*) is an explanatory drawing that shows a cross section taken along III-III in FIG. 3(*a*).

As described above, with respect to the barrier ribs 29, each barrier rib 29*b* in the row direction is divided into two portions in the column direction, and a groove at the divided position is formed as the vent passage 31. The vent passage 31 is utilized as a vent path when sealing the substrate on the front face side and the substrate on the back face side.

A raised portion 32 having a height lower than the height of the lateral barrier rib 29*a* is formed inside the vent passage 31. The height of the raised portion 32 is preferably set to about half the height of the lateral barrier rib 29*a*. The raised portion 32 is formed at a position overlapping with each address electrode A in a plan view.

This raised portion 32 is formed so as to prevent the lateral barrier rib 29*a* from falling toward the cell S when the material layer for barrier ribs, patterned into the shapes of barrier ribs, is fired. Since the height of the raised portion 32 is lower than that of the lateral barrier rib 29*a*, it is possible to prevent clogging of the vent passage 31 and consequently to provide a sufficient ventilation conductance property.

Figure 5A:
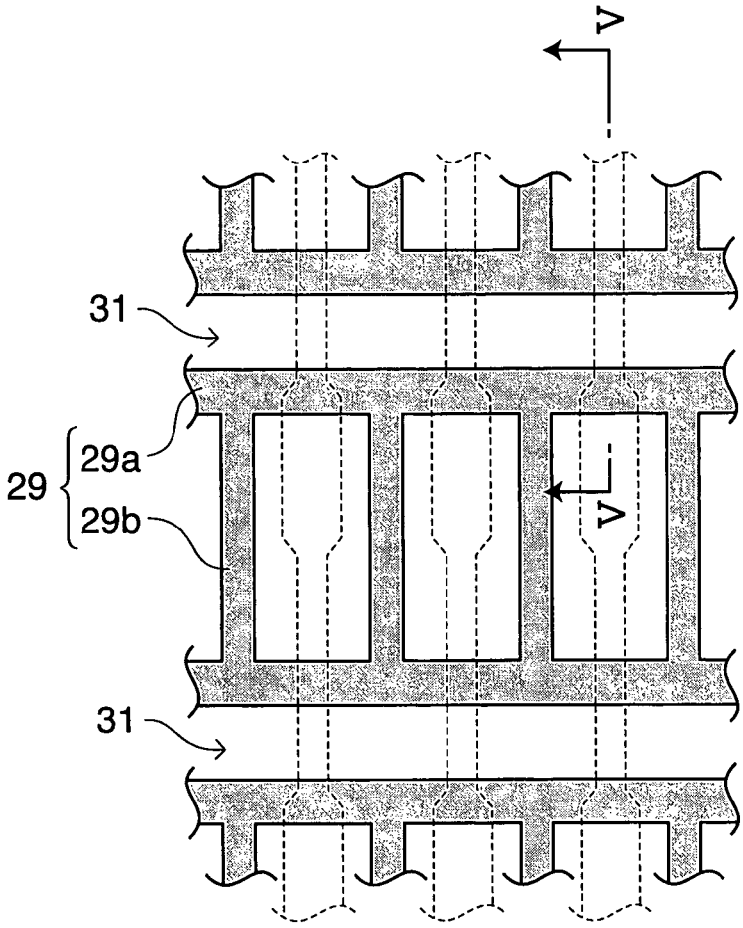
FIGS. 5(*a*) and 5(*b*) are explanatory diagrams showing a comparative example.
Figure 5B:
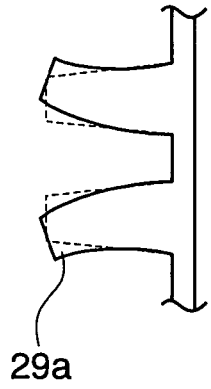

FIGS. 5(*a*) and 5(*b*) are explanatory diagrams that show a comparative example. FIG. 5(*a*) is an explanatory diagram that shows a state in which barrier ribs are viewed from above, and FIG. 5(*b*) is an explanatory diagram that shows a cross section take along V-V in FIG. 5(*a*).

As described above, barrier ribs 29 are formed by firing a material layer for barrier ribs having a pattern of barrier ribs formed thereon, and as shown in the figures, when no raised portions are formed, a stress that pulls the lateral barrier ribs 29*a* toward the cell S is exerted due to thermal shrinkage in firing the barrier ribs, and as indicated by slanting lines in FIG. 5(*b*), the lateral barrier ribs 29*a* fall toward the cell S side to cause a reduced aperture ratio of the cells, resulting in a problem of low display brightness. Moreover, the reduction in the aperture ratio impairs the stability in the phosphor applying process.

In contrast, since the structure of the barrier ribs in accordance with the first embodiment of the present invention is provided with raised portions 32, it is possible to reduce the possibility of falling of the lateral barrier ribs 29*a* due to thermal shrinkage at the time of firing the barrier ribs. Moreover, since the height of the raised portions 32 is made smaller than that of the lateral barrier ribs 29*a*, it is possible to obtain a sufficient ventilation conductance property.

Figure 4A:
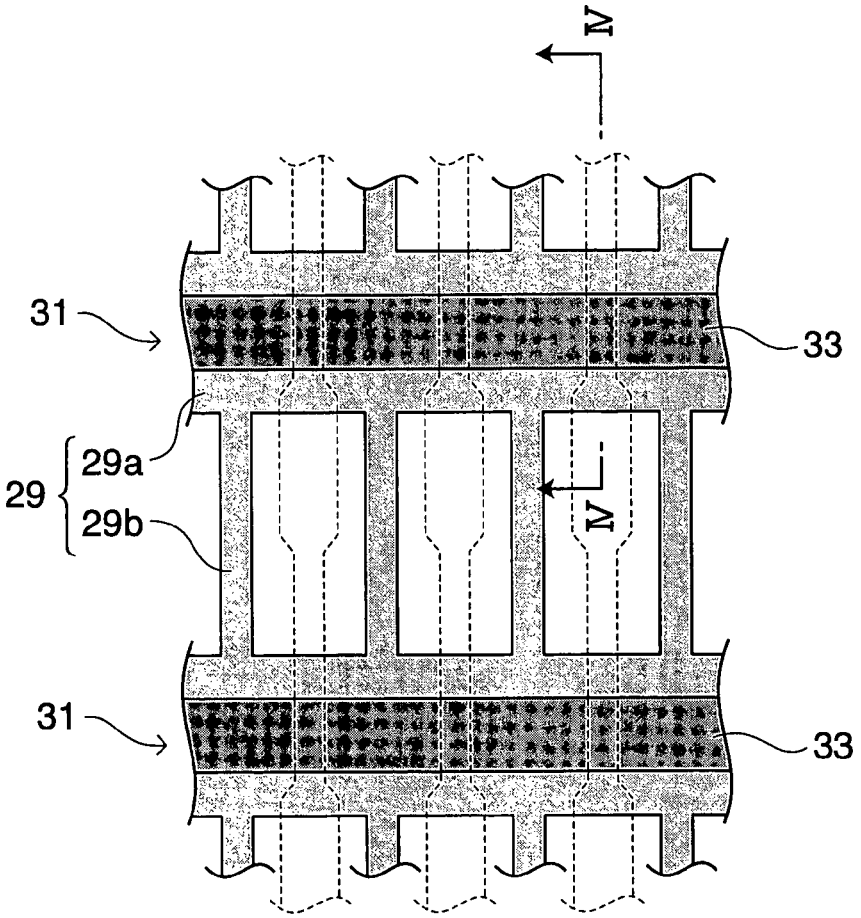
FIGS. 4(*a*) and 4(*b*) are explanatory diagrams showing a state in which the barrier ribs of a second embodiment of the present invention are viewed from above.
Figure 4B:
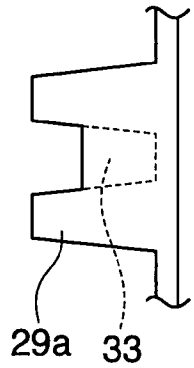

FIG. 4(*a*) is an explanatory diagram that shows a state in which barrier ribs in accordance with a second embodiment of the present invention are viewed from above, and FIG. 4(*b*) is an explanatory diagram that shows a cross section taken along IV-IV in FIG. 4(*a*).

In the present embodiment, the shape of the barrier ribs 29 is the same as that of the first embodiment; however, raised portions formed in a vent passage 31 are prepared as a raised portion 33 having a continuous belt shape along the lateral barrier ribs 29*a*. Even when such a belt-shaped raised portion 33 is used, the same effects as those of the first embodiment can be obtained.

As described above, in accordance with the present invention, a PDP is provided with barrier ribs including lateral barrier ribs extending in the row direction and longitudinal barrier ribs extending in the column direction, with a vent passage being formed at a position where each lateral barrier rib is divided into two portions in the column direction, and in this structure, the shape of the barrier ribs is designed so that a raised portion that is lower than the lateral barrier rib is formed in the vent passage; thus, it becomes possible to prevent the lateral barrier ribs from tilting toward the cell side at the time of firing the barrier ribs. With this structure, it is possible to prevent a reduction in the aperture ratio of the cells, without causing damages to the vent path used at the time of sealing the substrates; thus, it becomes possible to achieve a panel with high brightness and also to improve the stability in the phosphor applying process.

What is claimed is:

1. A plasma display panel comprising:

a pair of substrates forming a discharge space between the substrates; and lateral barrier ribs extending in a row direction and longitudinal barrier ribs extending in a column direction that divide the discharge space into cells, each lateral barrier rib being divided into two portions in the column direction such that a vent passage is formed in the divided portion, wherein raised portions, which are lower than the lateral barrier ribs and connect the lateral barrier ribs divided into the two portions with each other, are formed in the vent passage; and the raised portions are formed on a line connecting the centers of cell areas in the column direction.

2. The plasma display panel according to claim 1, wherein the height of the raised portions is set to about half the height of the lateral barrier ribs.

3. The plasma display panel according to claim 1, wherein the raised portions are formed at positions overlapping in a plane view with each of address electrodes formed on the substrate placed in the rear side of the pair of substrates.

* * * * *